US009756917B2

(12) United States Patent
Zech

(10) Patent No.: US 9,756,917 B2
(45) Date of Patent: Sep. 12, 2017

(54) HANGING AND STORAGE SYSTEM

(71) Applicant: Ellen Zech, Chicago, IL (US)

(72) Inventor: Ellen Zech, Chicago, IL (US)

(73) Assignee: Ellen Zech, Chicago, IL (US)

( * ) Notice: Subject to any disclaimer, the term of this patent is extended or adjusted under 35 U.S.C. 154(b) by 0 days.

(21) Appl. No.: 14/507,911

(22) Filed: Oct. 7, 2014

(65) Prior Publication Data

US 2016/0095404 A1 Apr. 7, 2016

(51) Int. Cl.

| | |
|---|---|
| ***A47F 1/14*** | (2006.01) |
| ***A47G 1/16*** | (2006.01) |
| ***B60R 1/02*** | (2006.01) |
| ***B65B 67/12*** | (2006.01) |
| ***A45C 13/00*** | (2006.01) |
| *A47G 29/08* | (2006.01) |

(52) U.S. Cl.
CPC ..... *A45C 13/001* (2013.01); *A45C 13/002* (2013.01); *A47G 29/08* (2013.01)

(58) Field of Classification Search
CPC ..... A47G 25/0671; A47G 25/0664
USPC ..... 248/470, 95, 914
See application file for complete search history.

(56) References Cited

U.S. PATENT DOCUMENTS 2,789,703 A * 4/1957 Kurtz ..... A47B 57/045 211/171
3,313,425 A * 4/1967 Injeski ..... A47G 25/0664 211/204
3,380,594 A * 4/1968 MacCluney ..... A47G 25/746 211/85.3
3,638,890 A * 2/1972 Burrell ..... A47G 25/28 211/113
4,086,709 A * 5/1978 Jackson ..... D06F 58/20 248/222.51
4,094,414 A * 6/1978 Thiot ..... A47G 25/0685 211/1.3
5,005,791 A 4/1991 Lanzen
(Continued)

FOREIGN PATENT DOCUMENTS

| | | |
|---|---|---|
| CN | 201256868 | 6/2009 |
| JP | H08258850 | 10/1996 |

(Continued)

OTHER PUBLICATIONS

Images of InterDesign Zia Swivel Hanging Hangbag Holder obtained from www.amazon.com, last visited Jun. 12, 2014.

*Primary Examiner* — Derek Battisti
(74) *Attorney, Agent, or Firm* — Beem Patent Law Firm; Zareefa Flener

(57) ABSTRACT

A hanging system for displaying, storing, and protecting handbags. The hanging system comprises a curved holder, a mounting system, and protective cover. The system ensures handbags are protected and maintain their original integrity by providing for adequate aeration, proper positioning, and protection from dust and light. The channels on the holder may hold the handles of the cover in place. The holder may have aeration holes to prevent mold growth and moisture buildup on the stored handbag. In mounting the holder a spacer ensures the bags hang without interference from the environment. The hanging system may be mounted to various substrates in a variety of configurations compatible with horizontal and vertical orientation based on user preference.

12 Claims, 14 Drawing Sheets

(56) References Cited

U.S. PATENT DOCUMENTS

| | | | | |
|---|---|---|---|---|
| 5,143,214 | A | 9/1992 | Freelander et al. | |
| 5,246,190 | A | 9/1993 | Swirkal | |
| 6,715,260 | B1 | 4/2004 | DeMatteis | |
| 6,726,156 | B1 | 4/2004 | Scola | |
| D632,898 | S | 2/2011 | Heroux | |
| 8,020,716 | B2 * | 9/2011 | Vitale | A47B 57/06 211/197 |
| 8,640,890 | B2 | 2/2014 | Schiller | |
| 2006/0054576 | A1 * | 3/2006 | Durham | A47L 23/205 211/85.7 |
| 2014/0048187 | A1 | 2/2014 | Marquez-Bottome | |

FOREIGN PATENT DOCUMENTS

| | | |
|---|---|---|
| JP | 2005212828 | 8/2005 |
| JP | 2005348759 | 12/2005 |
| JP | 2013146503 | 8/2013 |
| KR | 20130026660 | 3/2013 |

* cited by examiner

HANGING AND STORAGE SYSTEM

BACKGROUND OF THE INVENTION

1. Field of the Invention

The present invention relates to a storage system with one or more integrated features, such as a curved holder, a protective cover, a spacer and mounting system.

2. Description of the Related Art

A person with handbags may employ various systems for hanging, storage, and display only to find the handbags damaged from exposure to dust and light, inadequate aeration, insufficient spacing, and improper positioning. Exposure to those elements may result in the handbag becoming soiled, faded, cracked, moldy, or having scratches, indentations, or shape distortions. Once this kind of damage occurs, it often is irreversible. Traditional purse storage techniques like handbag boxes or handbag shelves are sometimes inadequate, because stored handbags may lose their natural shape, become soiled, suffer cracking, indentations or scratches to the leather.

Some hanging systems allow handbags to hang freely over hooks, however the handbag handles may crack due to the weight of the bag being centered in one spot on a handbag handle. Hanging systems with curved holders have been developed to reduce stress cracking on handbag handles, however modern handbag handles require sufficient aeration, which is not available on modern curved holders.

A dust bag may be employed to protect a handbag from damage due to dust and/or light during storage periods. There is currently no mechanism for a bag to be suspended in the hanging position and be covered in its entirety by a dust bag. Additionally, it is difficult to identify which handbag a dust bag contains. It may be cumbersome and time-consuming to inspect each dust bag to determine its contents.

What is needed is a system for hanging handbags that overcomes the problems described above.

SUMMARY OF THE INVENTION

In one embodiment, the hanging system may include: a surface curved about an axis with the surface having two generally parallel arcuate edges, a pair of channels running along each of the edges, and a pair of stops between each corresponding pair of channel and edge. Each one of said pair of channels has an outer wall or barrier opposite to a corresponding one of said stops. The front channel may be formed parallel between a stop and a wall; likewise the rear channel may be formed between a second stop and a second wall. In another embodiment, the holder may have a channel where the space between a wall and its respective stop is depressed. The holder may also have openings on the curved surface to promote air flow to the hanging handbag.

The hanging system may also include a spacer and hardware for mounting the holder onto a substrate, like a wall, rod, or onto a mounting system. The spacer allows the holder to be positioned away from the substrate, such as a wall or rod allowing the handbag to hang unimpeded. The hanging system may be mounted onto a rod that may or may not have an extender. The mounting system may be positioned generally vertically or horizontally and may be mounted to various substrates. The mounting system may permit the hanging system to be used in a variety of ways.

The hanging system also may include a cover comprising a reusable bag having an opening at a top of said bag; wherein the opening is provided with a drawstring closure.

The drawstring closure may be equipped with a pair of cord locks for closing the opening. The cover may have two handles positioned at the top of the bag and along the opening, and the handles are opposite one another on the bag. The handles of the cover may be formed by the drawstring that forms the drawstring closure. The cover may include a pair of straps, wherein each strap has a proximal end and a distal end. The proximal end is the end at which each strap connects to the bag, and the distal end is the end at which a first strap attaches to a second strap. The distal end of each strap may have mechanisms for connecting the two straps to one another such that a single fastened strap is formed.

In one embodiment, the protective cover may have a pocket for labels or pictures. In another embodiment, the protective cover may have a viewing window that is covered by an optional flap closure, which may be detachable. In another embodiment, the protective cover may have a pocket, viewing window, and an optional flap closure, which may be detachable. The viewing window may be a clear material with a plurality of aeration holes. The flap closure may be a piece of material having the same size or a larger size than the viewing window. The flap closure may have a mechanism for fastening to the bag to maintain closure. The pocket may be the same size or a different size as the protective flap.

DETAILED DESCRIPTION OF THE SEVERAL VIEWS OF THE DRAWINGS

DETAILED DESCRIPTION OF THE INVENTION

Figure 1:
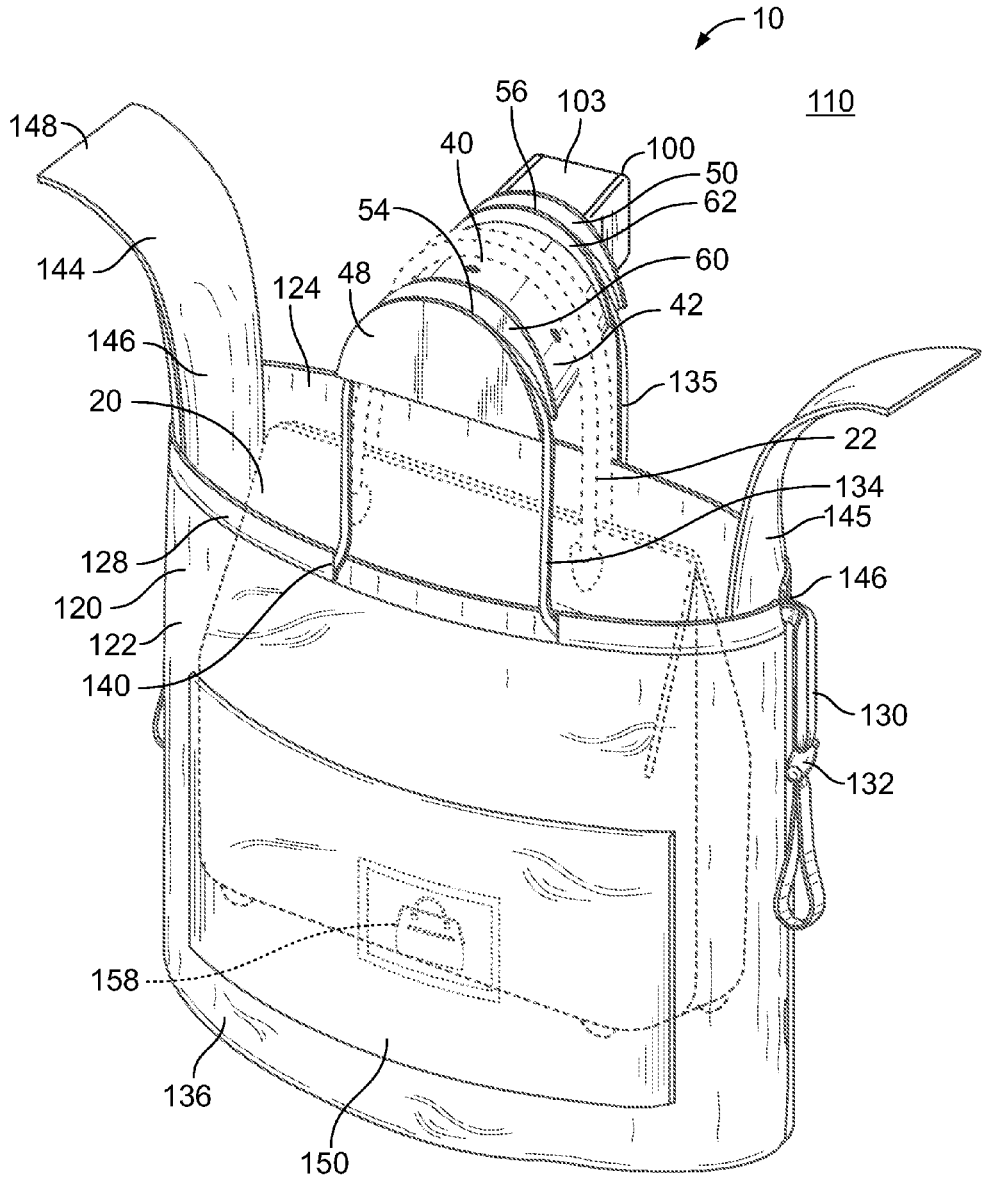
FIG. 1 is a perspective view from the top of one embodiment of a hanging system for handbags shown in use showing a cover in an open mode, with a pocket.
Figure 2:
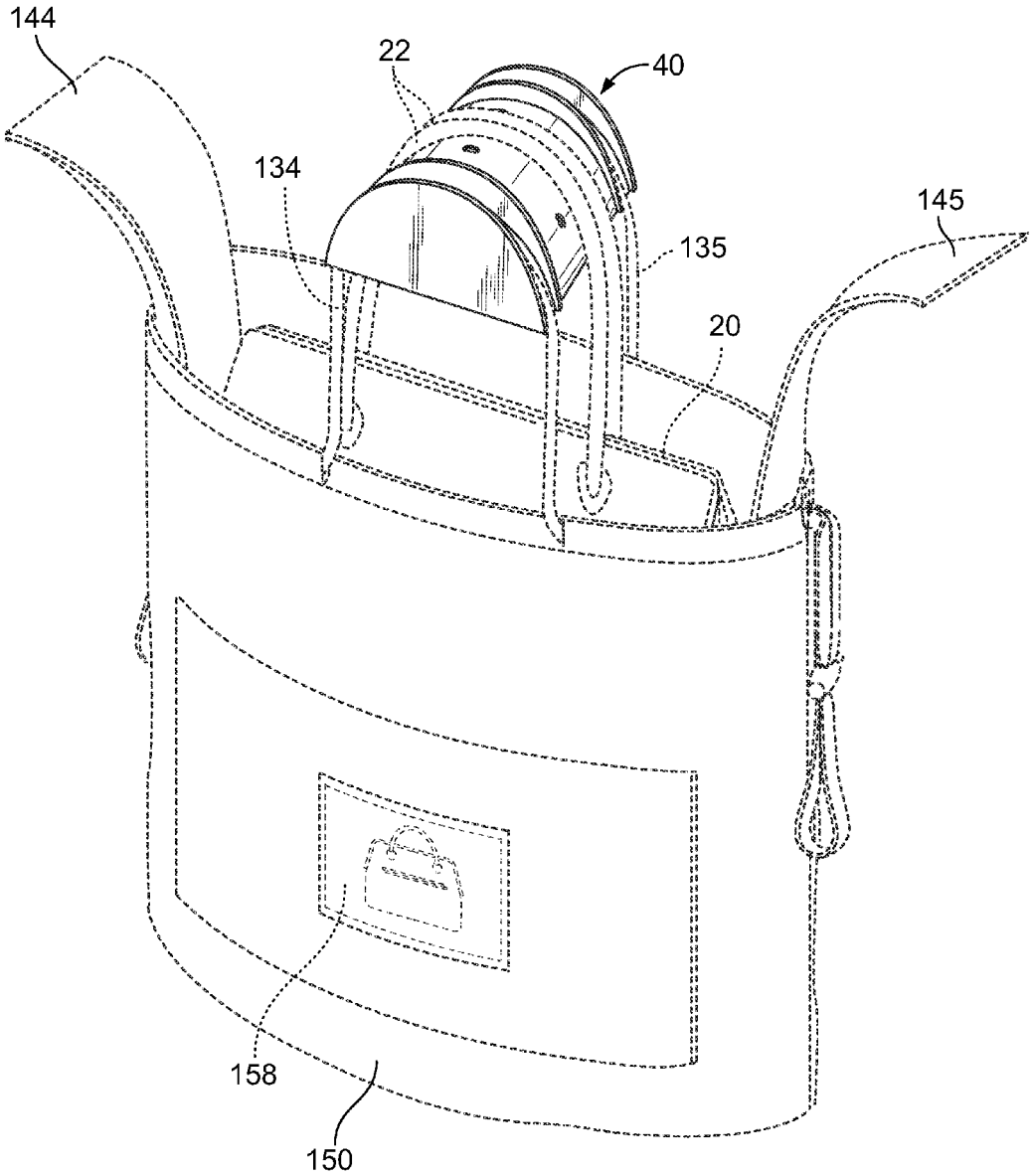
FIG. 2 is a perspective view from the top of one embodiment of a holder in a hanging system for handbags, with a handbag and cover shown as environment.

Referring to FIG. 1, hanging system 10 may be used for mounting, displaying, storing, and protecting purses, handbags and other similar items. Mounting and storing are made possible by holder 40, while protection against dust and light, more particularly UV light may be provided, by cover 120. Spacer 103 may space holder 40 from a substrate or hardware in order to protect an item from abrasion, crushing, or deformation.

Hanging System

FIGS. 1, 9-10, and 17-19 show hanging system 10 which may have three principal components: holder 40, cover 120, and mounting system 100. Hanging system 10 may be mounted to a substrate, as illustrated in FIGS. 1, 10-11, and 18-19. In one embodiment, as shown in FIGS. 10-11 and 18-19, hanging system 10 is mounted to a substrate, such as wall 110 or rod 112. Hanging system 10 is designed to provide a way for users to store one or more handbags 20 while protecting the shape and integrity of each. Hanging system 10 may permit a plurality of holders 40 to be mounted to a single substrate. Users may position holders 40 on a substrate in a way that maximizes the number of hanging handbags 20 while preserving an individual handbags 20 ability to hang freely.

Holder

As shown in FIGS. 1, 3-10, and 17, holder 40 of handbag 20 may be designed to mimic the natural curvature of a human shoulder, and thereby preserve the structure and integrity of hanging handbag 20 and its handle 22. The holder 40 may have a front barrier or wall 48, rear barrier or wall 50, generally semi-cylindrical curved surface 42 having two generally parallel arcuate edges, and channels 54 and 56. Holder 40 may have a longitudinal axis 44 around which curved surface 42 is oriented.

In one embodiment holder 40 may be comprised of a material such as plastic or metal which may have a smooth, textured, or flocked finish. An example of such a plastic material is polystyrene. In one embodiment, holder 40 may be comprised of a rigid plastic with a thickness that can support the weight of hanging handbag 20 and cover 120.

Figure 3:
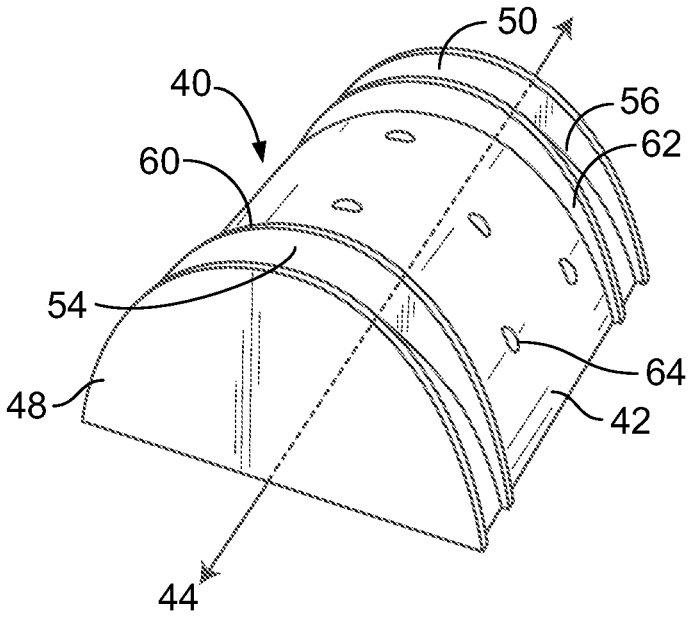
FIG. 3 is a perspective view from the top of one embodiment of a holder in a hanging system for handbags.

As shown in FIG. 3, curved surface 42 has a length that runs parallel to longitudinal axis 44 of holder 40. The curved surface 42 may be delimited by front stop 60 and rear stop 62. The distance between front stop 60 and rear stop 62 being between about 2 cm and about 16 cm, preferably between about 5 cm and about 13 cm, and in one embodiment about 7 cm. The length may accommodate a variety of handbag handle(s), including single handles, multiple handles, chain handles, rope handles, thin handles, wide handles, and many more.

Figure 6:
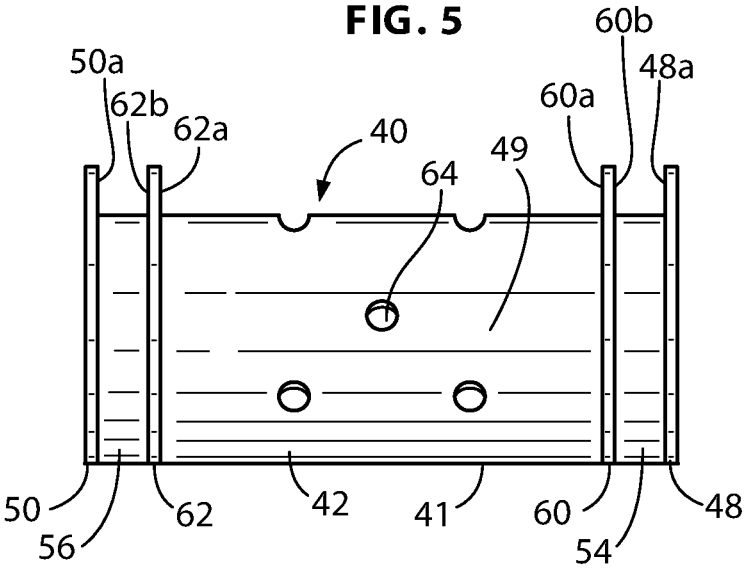
FIG. 6 is a left view of the holder of FIG. 3.
Figure 7:
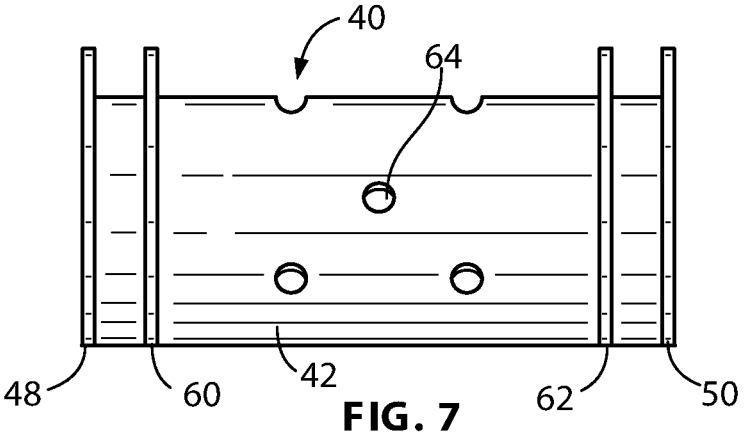
FIG. 7 is a right view of the holder of FIG. 3.
Figure 8:
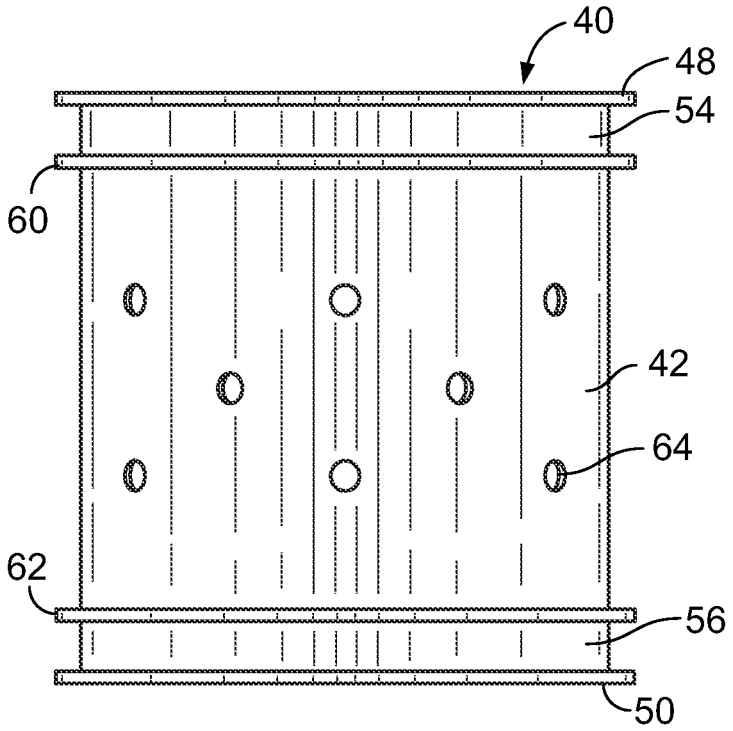
FIG. 8 is a top view of the holder of FIG. 3.
Figure 10:
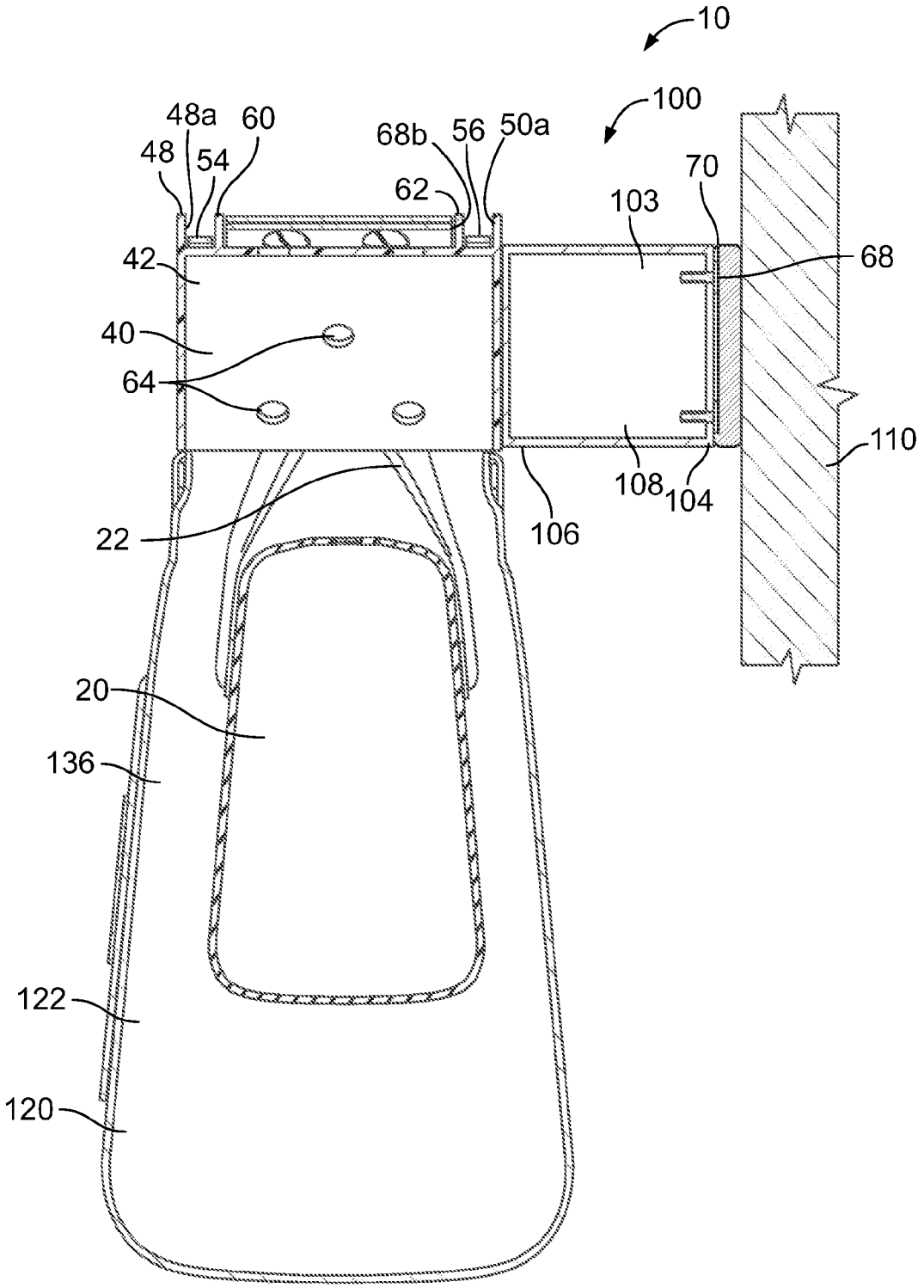
FIG. 10 is a section taken along plane 10-10 of FIG. 9.

As shown in FIGS. 6 and 10, the length of curved surface 42 may be delimited by a pair of stops with respective faces 60*a* and 62*a* on holder 40. Curved surface 42 may have an arc length between about 8 cm and about 24 cm, preferably between about 11 cm and about 20 cm, and in one embodiment about 15.5 cm. The sides 49 of the curved surface retreating downwards from the crest or arc of the curved surface each terminate in a termination end 41, each end 41 separated by a linear distance. The linear distance between the stops 60, 62 of the arc of curved surface 42 of holder 40 may be separated by a linear distance of between about 2 cm and about 16 cm, preferably between about 5 cm and about 13 cm and in one embodiment about 8 cm. The shoulder-like curvature should distribute the stress on the handle of the purse or handbag 20 over a large area as smaller distributions may cause stress cracking, fractures, and shape distortions on a handbag handle 22.

As shown in FIGS. 1, 3-4, and 6-8, in one embodiment, holder 40 may have aeration holes 64 on curved surface 42 to encourage airflow to the handbag handle 22 and to minimize the likelihood of moisture buildup and subsequent mold growth.

As shown in FIGS. 6 and 10, in one embodiment, holder 40 may have channels 54 and 56. Channels 54 and 56 may be formed between outer barriers or walls 48 and 50, and respective stops 60 and 62. Front channel 54 may be formed between front wall face 48*a* and front stop face 60*b*. Rear channel 56 may be formed between rear wall face 50*a*, rear stop face 62*b*. Front channel 54 may run parallel and proximate to front wall 48. Rear channel 56 similarly may run parallel and proximate to rear wall 50. The height of the base of the channels 54 and 56 may be the same (shown) or different (not shown) relative to the height of curved surface 42.

Figure 9:
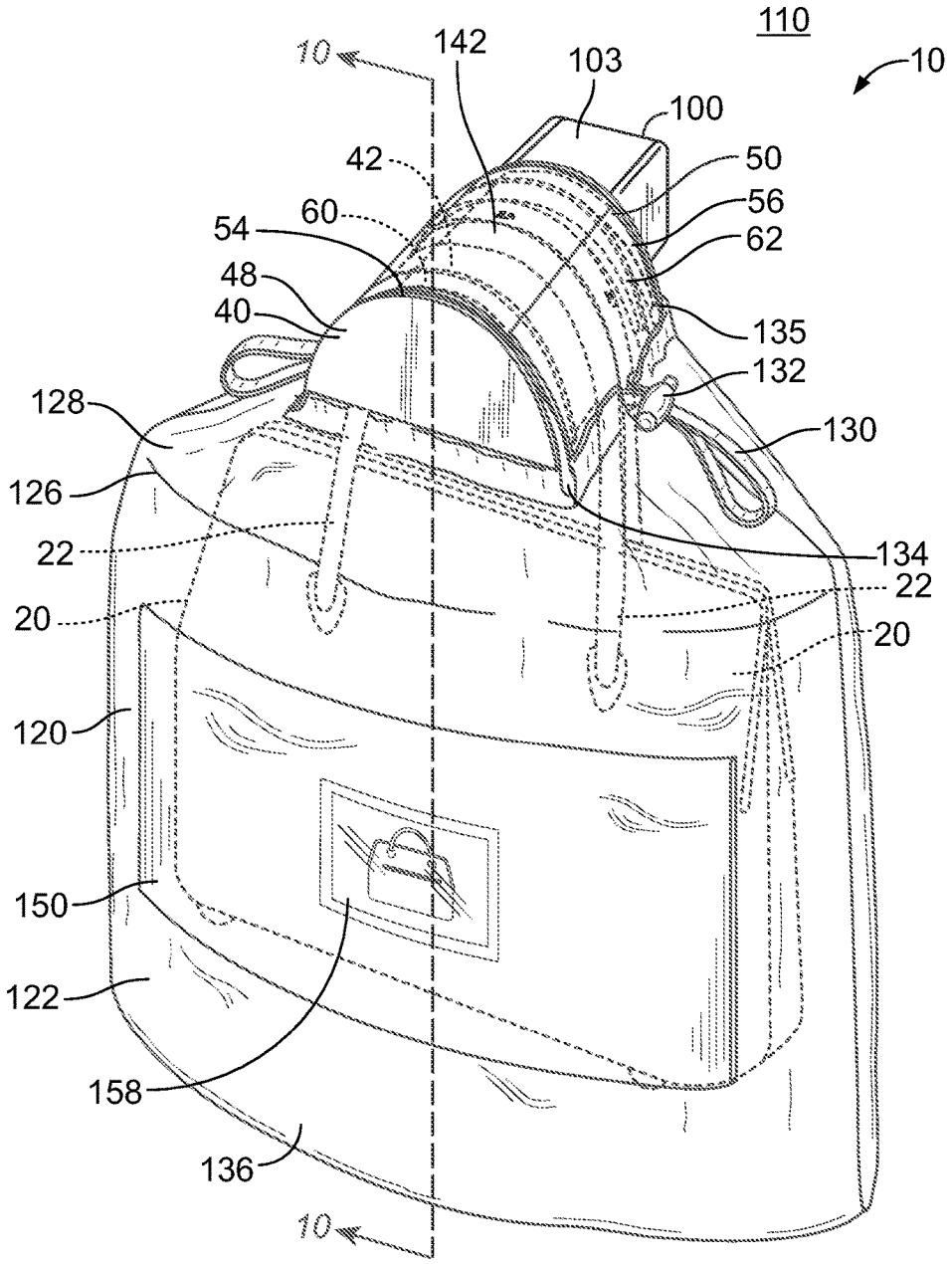
FIG. 9 is a perspective view from the top of one embodiment of a hanging system for handbags showing a cover in a closed mode, with closed straps.

Each wall, 48 and 50, may have a height from the base of the channel to the top of the wall which may be between about 0.2 cm to about 5 cm, preferably between about 0.3 cm and about 3 cm, and in one embodiment about 0.5 cm. Each stop, 60 and 62, may have may have a height from the base of the channel to the top of the stop which may be between about 0.2 cm to about 4 cm, preferably between about 0.3 cm and about 2 cm, and in one embodiment about 0.5 cm. Each stop 60 and 62 may be a ridge (shown), one or more raised bumps (not shown), or another feature for impeding movement of handbag handle(s) 22, handles 134 and 135, and/or fastened strap 142. The outer barriers or walls 48 and 50 and respective stops 60 and 62 may be of the same height (shown) or different heights (not shown). In FIG. 1, stops 60 and 62 may prevent slippage of handles 134 and 135 of cover 120 and handles 22 of handbag 20. In FIG. 9, stops 60 and 62 may prevent slippage of handles 134 and 135 of cover 120, handbag handles 22, and fastened strap 142. Each channel 54 and 56 may have a height and length that can accommodate the handles 134 and 135 of cover 120.

As shown in FIGS. 1, 3, 5, 8, 10, holder 40 may have two channels, 54 and 56, that may allow cover 120 to rest on the holder 40. Cover 120 may have two handles 134 and 135, and handles 134 and 135 may be designed to fit into a respective channel 54 and 56.

In one embodiment (not shown), channels 54 and 56 of holder 40 may be formed by recesses in the curved surface 42; one recess proximate and parallel to front wall 48 and one recess proximate and parallel to the rear wall 50. In this embodiment, each channel 54 and 56 may have a respective stop 60 and 62 to prevent handle 22 of handbag 20 from slipping into channels 54 and 56.

As shown in FIGS. 1, 3-10, and 17, in one embodiment, front wall 48 and rear wall 50 each may have a semi-circular shape and be positioned at the outside of respective channels 54 and 56 generally parallel to stops 60 and 62. Each of the walls 48 and 50 may be shaped as half of a circle, half an oval, or half an ellipse. Preferably both walls 48 and 50 will have the same predetermined shape.

As shown in FIGS. 1 and 9, holder 40 may have front wall 48 and rear wall 50. Walls 48 and 50 may have a height from the base of channels 54 and 56 greater than that of curved surface 42 to provide an impeding feature which may prevent handbag handle(s) 22, cover handles 134 and 135, and/or fastened strap 142 from slipping off holder 40.

Figure 4:
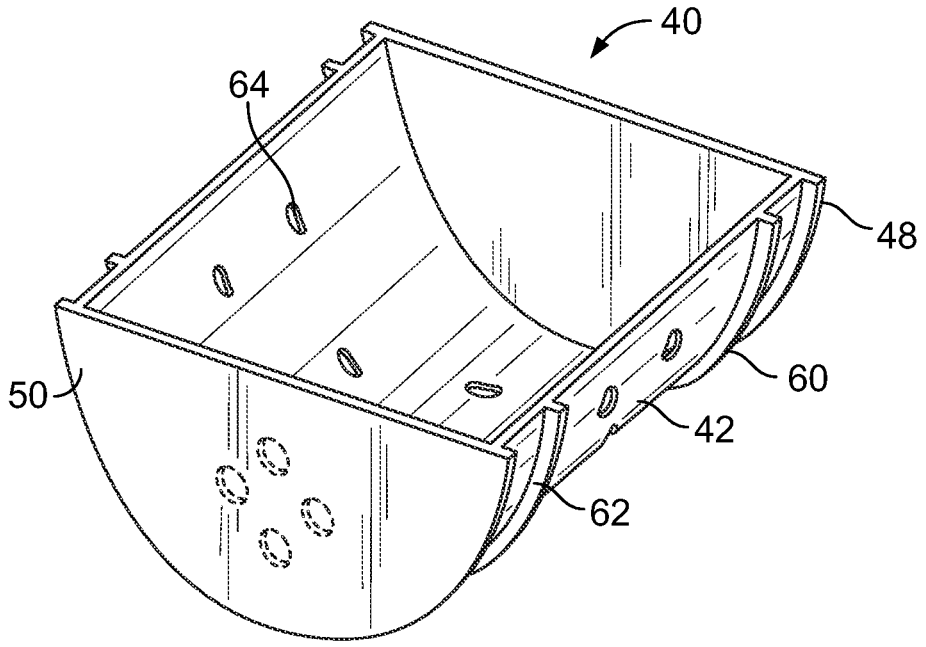
FIG. 4 is a perspective view of the bottom of the holder of FIG. 3.
Figure 5:
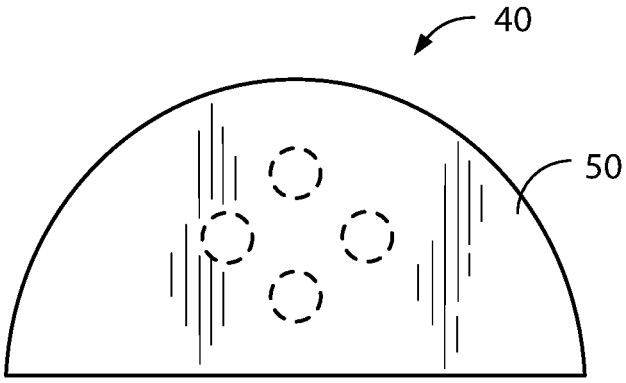
FIG. 5 is a rear view of the holder of FIG. 3.

As shown in FIGS. 4 and 5, in one embodiment, there may be openings or fasteners positioned on rear wall 50 of holder 40.

Mounting System

As shown in FIGS. 1, 10, and 17-19, hanging system 10 may be designed to mount holder 40 onto a substrate, like wall 110 or rod 112, via mounting system 100 to allow handbag 22 or like product to hang freely without impediment. Holder 40 may be positioned with curved surface 42 upward. Holder 40 may be attached to a substrate or surface either directly or using spacer 103. In one embodiment, holder 40 of hanging system 10 may attach to mounting system 100 which may comprise spacer 103 and mounting hardware.

In one embodiment, the mounting system may include a spacer 103, which allows a handbag 20 to hang freely without interference from its environment. Spacer 103 may have two opposing sides 104 and 106 and distance between the two sides being length 108. Length 108 may be between about 1 cm and about 12 cm, preferably between about 2 cm and about 8 cm, and in one embodiment about 3 cm to allow handbag 20 to hang freely without colliding with or being impeded by the mounting surface. Sides 104 and 106 may have a height and width between about 10% and about 90%, preferably between about 25% and about 75% of holder 40 rear wall 50.

In one embodiment side 106 of spacer 103 may be attached to rear wall 50 of holder 40 using a fastener. The fastener attaching side 106 of spacer 103 to rear wall 50 of holder 40 may or may not be permanent fastener. In one embodiment side 106 of spacer 103 may be attached to rear wall 50 of holder 40 using a fastener such as: joints, dowels, inserts, bolts, brackets, anchors, self-drilling screws, or other alternative fasteners. As shown in FIG. 10, in one embodiment permanent adhesive may be used as the fastener. In another embodiment the spacer 103 may be integral with holder 40 (not shown).

As shown in FIGS. 1, 9-11, and 17-19, side 104 of the spacer 103 may permit spacer 103 to be mounted to a substrate such as a wall 110 or rod 112 using a fastener such as clamps, dowels, inserts, bolts, brackets, anchors, self-drilling screws, or other alternative fasteners. Spacer length 108 between sides 104 and 106 may permit rear wall 50 of holder 40 to be spaced from substrate such as a wall 110 or rod 112 to allow handbag 20 to hang freely without colliding with or being impeded by the mounting surface.

Figure 11:
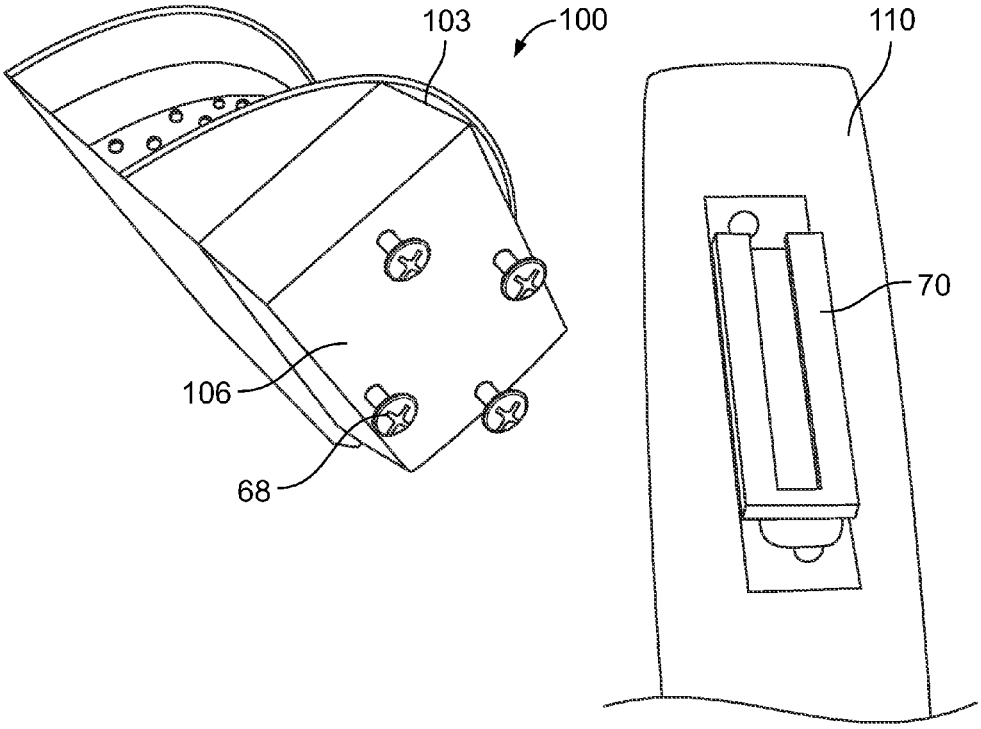
FIG. 11 is a perspective view of one embodiment of the mounting system.
Figure 12:
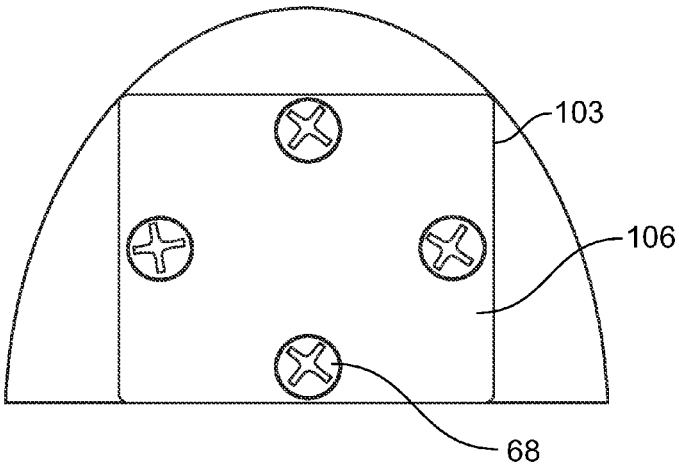
FIG. 12 is a rear view of one embodiment of mounting system spacer of FIG. 11.

As shown in FIGS. 11-12, mounting system 100 may attach holder 40 to a substrate using spacer 103, wherein side 104 of spacer 103 may have four heads 68, one or more of which may be used to attach to latch 70 which may be mounted to a substrate. As shown in FIGS. 11 and 12, two of the heads 68 may be aligned along the horizontal midline and two heads 68 may be aligned along the vertical midline on side 104 of spacer 103. Latch 70 may be fastened to a surface or substrate such as wall 110 using screws or anchors, such as dry wall screws or dry wall anchors, for example those sold under the mark E-Z ANCOR. Latch 70 may be positioned either horizontally or vertically. The user may fasten either the horizontal or vertical heads 68 on side 104 of spacer 103 with latch 70 to orient the curved surface 42 upwards for user convenience.

Figure 17:
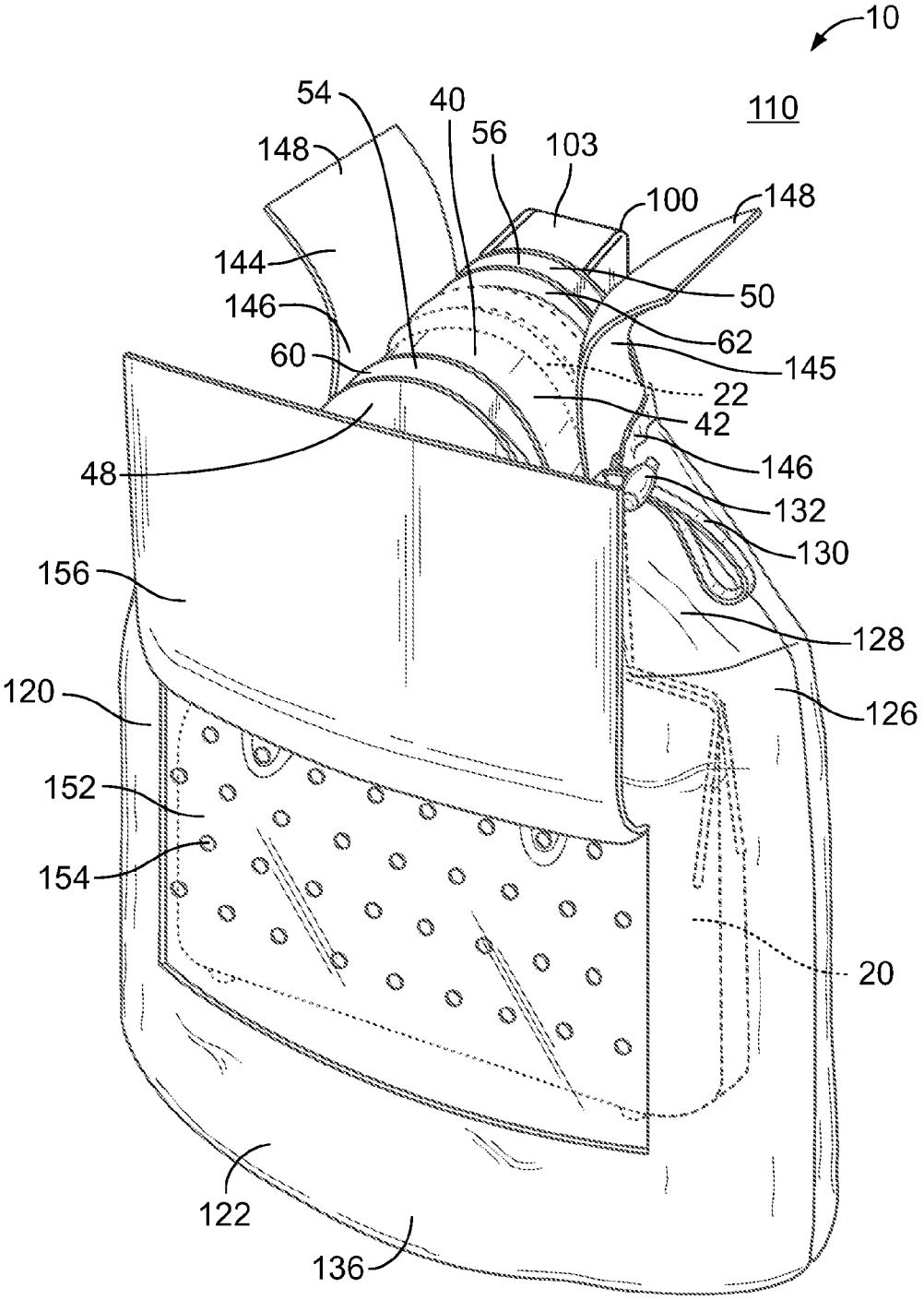
FIG. 17 is a perspective view from the top of one embodiment of a hanging system for handbags showing a cover in a closed mode, having an open flap and aerated window.
Figure 18:
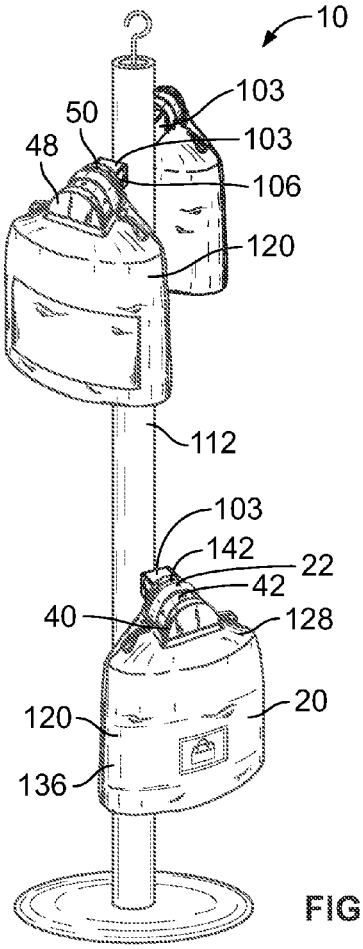
FIG. 18 is a perspective view of one embodiment of a hanging system for handbags shown in use on a vertical rod and mounting system.
Figure 19:
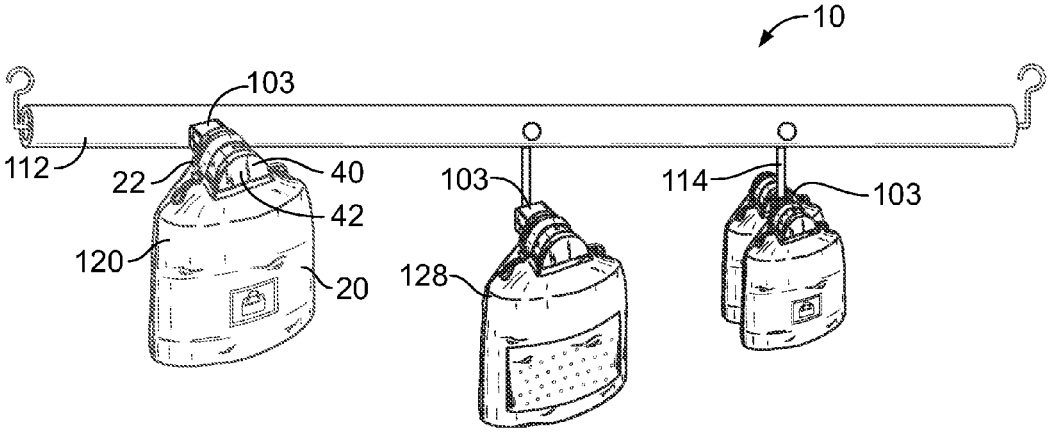
FIG. 19 is a perspective view of one embodiment of a hanging system for handbags shown in use on a horizontal rod and mounting system.

As shown in FIGS. 17-19, mounting system 100 may have a horizontal orientation, a vertical orientation, or in some combination thereof to allow holder 40 and spacer 103 to be mounted to various surfaces or substrates with different directional orientations such as rod 112 oriented horizontally or rod 112 oriented vertically. One or more holder(s) 40 and spacer(s) 103 may be attached to a surface or substrate such as wall 110 or rod 112. As shown in FIGS. 18-19, in one embodiment there may be multiple holders 40 and spacers 103 fastened to rod 112 at varying points along rod 112 and or multiple sides of rod 112 at the same point. Additionally, an extender 114 may be used to allow for even greater hanging capacity as shown in FIG. 19. In one embodiment, a collar mechanism may be used to fasten one or more latches 70 to rod 112 (not shown). Horizontal or vertical heads 68 on side 104 of spacer 103 may fasten to latches 70 to orient curved surface 42 upwards.

Rod 112 may be oriented horizontally or vertically and mounted with mounting hardware such as floor pedestals, closet rod hooks, over the door mounts, ceiling mounts, and wall mounts. Alternatively, horizontally oriented rods 112 and vertically oriented rods 112 can be joined together in a lattice formation and mounted with standard mounting hardware such as floor pedestals, closet rod hooks, over the door mounts, ceiling mounts, and wall mounts.

Cover

As shown in FIGS. 1 and 13-17, cover 120 may protect handbag 20 from exposure to dust, light, and other natural elements. The cover 120 may have a body that is generally bag 122 with opening 124 at top 126 that can be closed by drawstring closure 128. Drawstring closure 128 may be comprised of drawstring 130 and two cord locks 132, where cord locks 132 are positioned generally opposite one another to ensure that the purse can be protected equally from all directions.

Protective cover 120 is intended to protect purses and handbags 20 of various sizes and dimensions. Cover 120 may have a depth and a width between about 25 cm and about 75 cm. Cover 120 may be available in various sizes: a first size having a depth and width between about 25 cm and about 40 cm for clutches and extra small handbags, a second size having a depth and width between about 35 cm and about 45 cm for small handbags, a third size having a depth and width between about 40 cm and about 55 cm for medium handbags, a fourth size having a depth and width between about 45 cm and about 60 cm for large handbags, and a fifth size having a depth and width between about 55 cm and about 70 cm for extra large handbags and tote bags.

In one embodiment, protective cover 120 may be made from a breathable material, such as those made from natural fibers, to encourage adequate aeration and to prevent indentations, scratches, and shape distortions of the handbag. The protective cover may be made from plant-based material, animal-based material, synthetic material, or a combination of the listed types.

As shown in FIGS. 1-2 and 13-15, protective cover 120 may have pair of handles, 134 and 135, that allow cover 120 to hang on holder 40 which may permit handbag protection when hanging system 10 is in the operative mode. Handles 134 and 135 may be positioned generally opposing each other and situated to fit into channels 54 and 56 without twisting or distorting handbag 20. Handles 134 and 135 may be placed along opening 124 of bag 122.

In one embodiment, as shown in FIGS. 1-2 and 13-17, handles 134 and 135 may be formed by drawstring 130 that is also used as drawstring closure 128. In this embodiment, drawstring closure 128 may be closed by pulling drawstring 130 pull through cutouts or openings 140 in bag 122 to form handles 134 and 135. In this embodiment handles 134 and 135 are retractable and handles 134 and 135 may disappear when the drawstring closure 128 is opened to allow for easy insertion and removal of handbag 20 from protective cover 120. This embodiment also ensures that drawstring closure 128 will not seal in a way that puts excessive pressure on handbag 20 or handle 22. In this embodiment, openings or cutouts 140 through which the drawstring 130 pulls may be spaced in a way to form handles 134 and 135 that exactly fit channels 54 and 56 of holder 40. In another embodiment handles 134 and 135 are separately attached in generally opposite sides of the top 126 of bag 122.

FIGS. 13-17 show, in one embodiment, protective cover 120 may have a front panel 136 and a rear panel 138, and there may be one handle 134 on front panel 136 and one handle 135 on rear panel 138.

Figure 15:
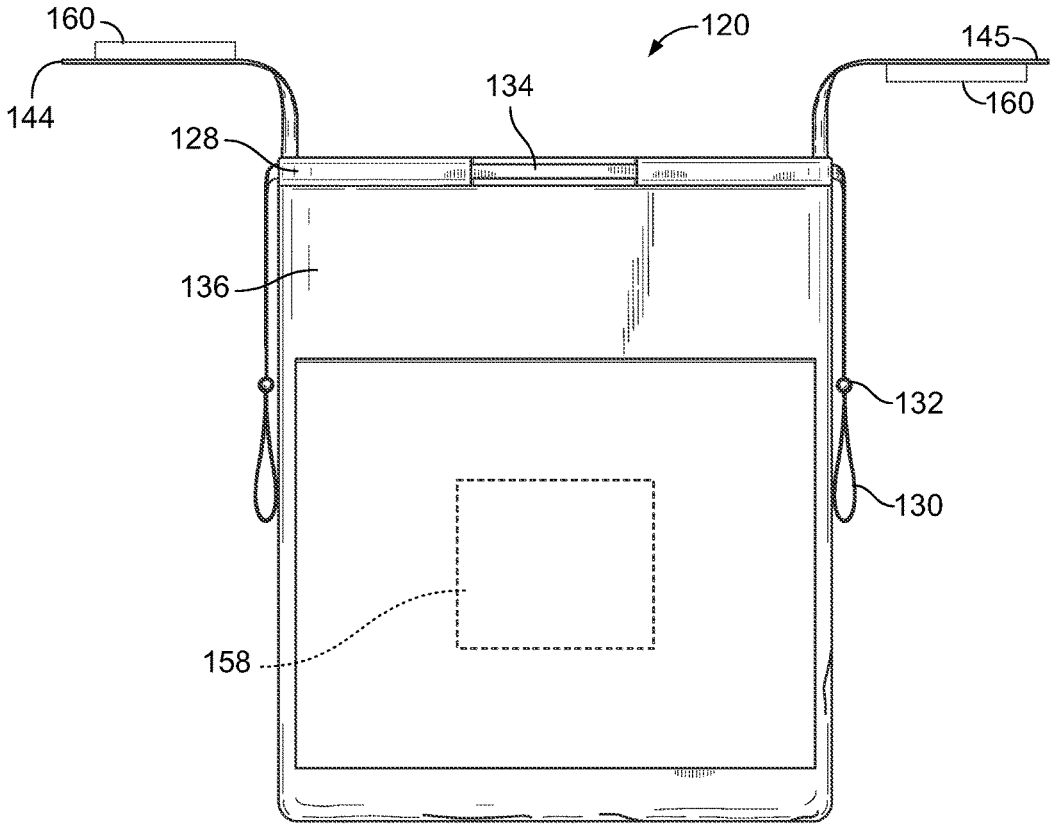
FIG. 15 is a front view of the cover of FIG. 13.
Figure 16:
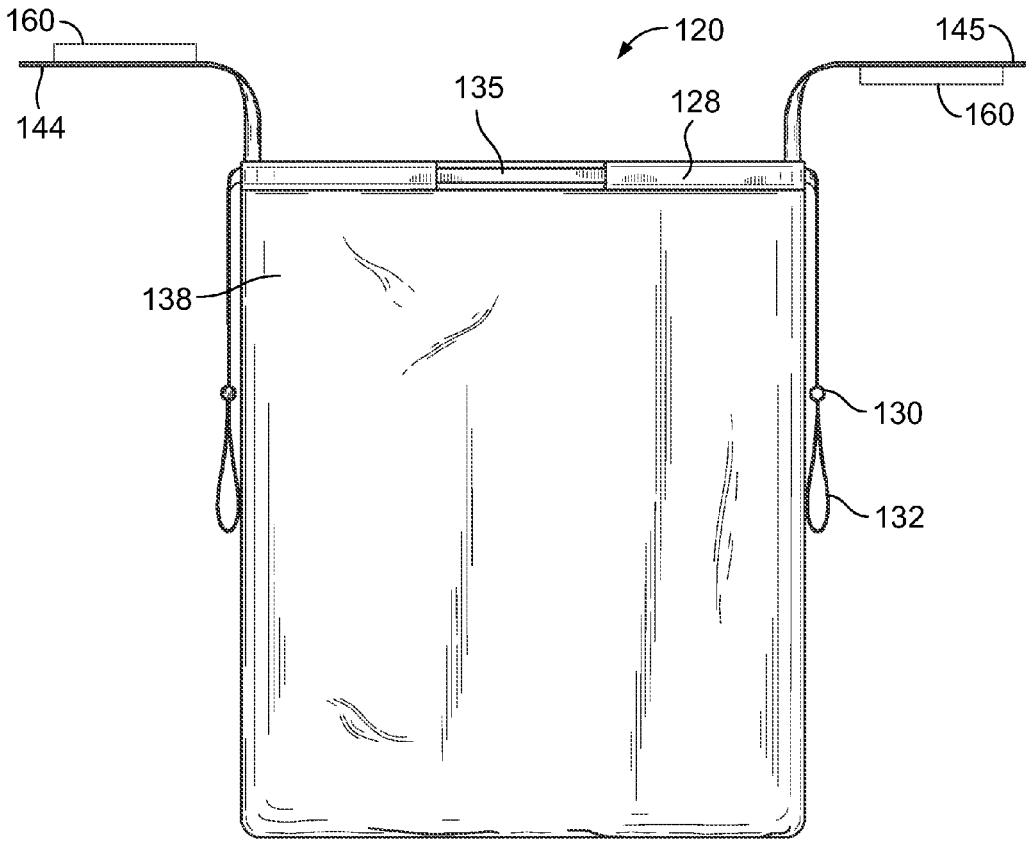
FIG. 16 is a rear view of one embodiment of a cover in a hanging system for handbags.

As shown in FIGS. 1, 15, and 17, protective cover 120 may have fastened strap 142 that drapes over holder 40 to protect handbag handle(s) 22 from exposure to various elements. Fastened strap 142 may be formed using one or more straps that may be detachable to the cover 120. In one embodiment the fastened strap 142 is formed by a single strap fastened to generally opposite sides of the top 126 of the cover 120. In another embodiment, the fastened strap 142 may be formed by fastening straps 144 and 145 at their distal ends 148. Preferably the fastened strap 142 may be formed by fastening straps 144 and 145 in an overlapping arrangement.

In one embodiment, straps 144 and 145 may have a width between about 2 cm and about 15 cm, preferably between about 5 cm and about 11 cm, and in one embodiment a width of about 7 cm. In one embodiment, straps 144 and 145 may have a length between about 10 cm and 50 cm, preferably between about 15 cm and about 30 cm, and in one embodiment a length of about 27 cm such that fastened strap 142 will adequately cover handbag handle 22.

Figure 13:
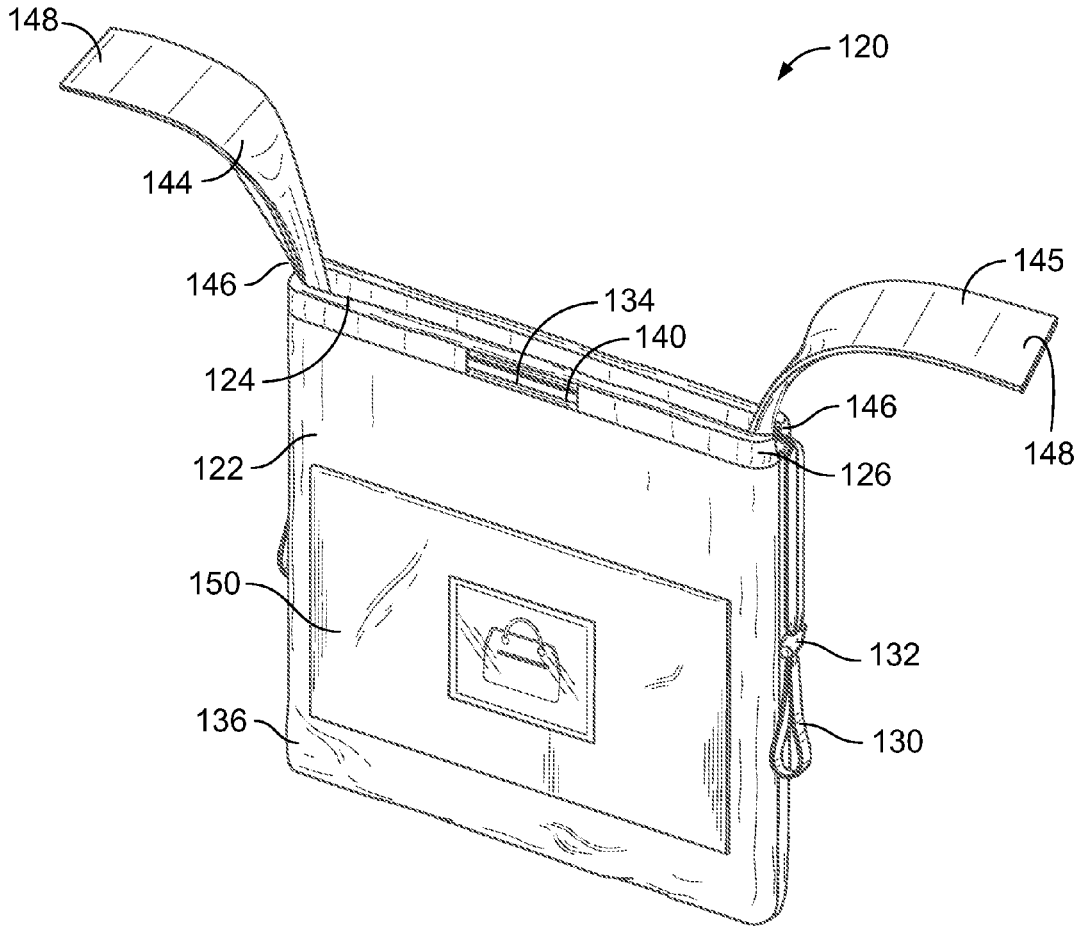
FIG. 13 is a perspective view of one embodiment of a cover in a hanging system for handbags with an optional pocket.

As shown in FIGS. 1, 13 and 17, in one embodiment proximal end 146 of each strap 144 and 145 may be the point at which each strap attaches to bag 122 generally opposite one another and generally at top 126 of bag 122. Straps 144 and 145 may be permanently attached to bag 122 or may be attached to bag 122 with a detachable mechanism, which allows a user to remove the straps from the cover. Straps 144 and 145 attach to one another at their respective distal ends 148 to form fastened strap 142. Each strap 144 and 145 has a mechanism for fastening to the opposing strap, such as hook and loop, buttons, snaps, or zipper. In one embodiment, straps 144 and 145 may have compatible hook and loop fasteners such as sold under the brand VELCRO, and each piece of hook and loop material is long enough that the formed fastened strap 142 has an adjustable length between about 10 cm and 60 cm, preferably between about 20 cm and about 50 cm, and in one embodiment about 46 cm depending on user preference.

Figure 14:
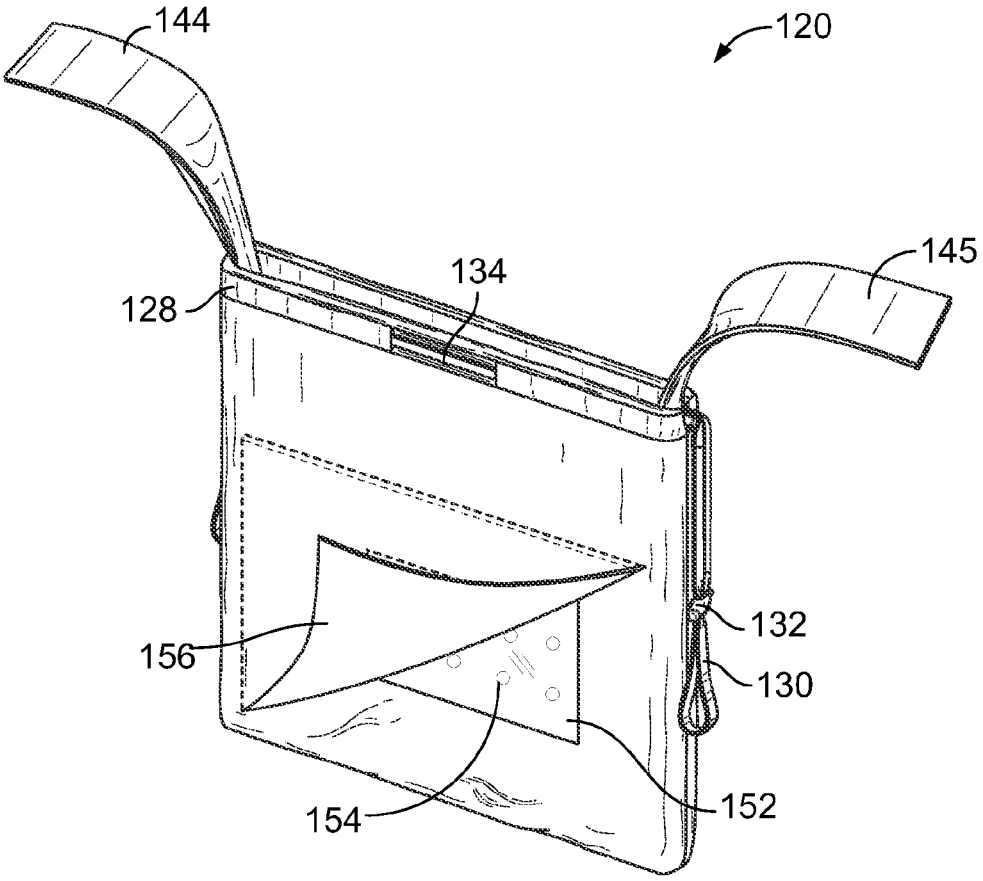
FIG. 14 is a perspective view of one embodiment of a cover in a hanging system for handbags with an optional flap raised to show an optional window.

As shown in FIGS. 14 and 17, protective cover 120 may have window 152 which may enable a user to view handbag 20 without having to remove handbag 20 from protective cover 120. In one embodiment, window 152 may be positioned on the front side 136 of protective cover 120. Window 152 may have a height between about 35% and about 60% of the height of the front side 136 of the cover 120. Window 152 may have a width between about 40% and about 80% of the width of the front side 136 of the cover 120. Window 152 may be positioned at a lower middle part of front side 136 of protective cover 120. This positioning allows a user to easily view the hanging handbag while the handbag is hanging, regardless of the size of the handbag. Because it is desirable to protect a hanging handbag from light, it is preferable for the window to not have the full height and width of front side 136 of protective cover 120.

As shown in FIGS. 14 and 17, in one embodiment, window 152 may have aeration holes 154 to promote ventilation and allow air to flow to handbag 20 inside protective cover 120. In one embodiment, window 152 is may be covered by a flap 156 that has the same or slightly larger area than window 152. In one embodiment flap 156 may have an optional detachable (not shown). Flap 156 may have fastener(s) that permit flap 156 to remain in a closed position over window 152. Flap 156 may be sized and positioned to prevent handbag 20 from being exposed to dust, light, or other elements, which may damage handbag 20.

As shown in FIG. 1, in one embodiment, protective cover may have pocket 150 for displaying labels or pictures to identify purse or handbag 20 hanging on holder 40 and inside protective cover 120. The size of pocket 150 may vary depending on the size of cover 120. Pocket 150 may be clear and may have a height between about 5 cm and about 60 cm, preferably about 10 cm and about 45 cm, and in one embodiment about 17 cm and a width between about 5 cm and about 60 cm, preferably about 10 cm and about 45 cm, and in one embodiment a width of about 20 cm.

Additionally in another embodiment protective cover 120 may have a window 152, a detachable flap 156, and a pocket 150.

While the foregoing written description enables one of ordinary skill to make and use what is considered presently to be the best mode thereof, those of ordinary skill will understand and appreciate the existence of variations, combinations, and equivalents of the specific exemplary embodiments and methods herein. The invention should therefore not be limited by the above described embodiments and methods, but by all embodiments and methods within the scope and spirit of the invention as claimed.

What is claimed is:

1. A handbag holder comprising:

a surface curved about an axis, said curved surface having a crest, two sides, and two generally parallel arcuate edges, wherein on said crest of said curved surface there is a linear distance of between about 5 cm and about 13 cm between the two generally parallel arcuate edges, and wherein each of said sides of the curved surface flares downwardly and outwardly from said crest terminating in a termination end and wherein there is a linear distance between each termination end;

a pair of stops, each one of said stops extending radially from and above said curved surface and located proximate to a corresponding one of said arcuate edges;

a main channel formed between said pair of stops configured to receive a handbag handle;

a pair of outer barriers, each one of said outer barriers forming a corresponding side channel within a corresponding one of said stops wherein each said outer barrier extends a distance of between about 0.3 cm and about 3 cm above said corresponding side channel;

wherein said crest has a linear profile between said arcuate edges, and wherein each one of said outer barriers is generally perpendicular to said curved surface, and wherein said main channel and each said side channel are disposed along said curved surface; wherein said plurality of channels also includes front and rear channels, and wherein said main channel is substantially broader than each of said front and rear channels.

2. A handbag holder according to claim 1 wherein said curved surface has one or more holes for passive aeration of a handbag handle and wherein an open aperture is defined under said curved surface along the linear distance between the termination ends.

3. A system comprising:

a handbag holder wherein said handbag holder includes a surface curved about an axis, said curved surface having a crest, two sides, and two generally parallel arcuate edges, wherein said two sides span a linear distance of between about 5 cm and about 13 cm between said two arcuate edges, wherein said two sides of said curved surface flares downwardly and outwardly from said crest terminating in a termination end and wherein a linear distance spans between said ends, a plurality of stops, each one of said plurality of stops extending radially outward from and above said curved surface and generally perpendicular to said curved surface, a pair of outer barriers located at a corresponding one of said arcuate edges, a plurality of channels, each one of said channels formed between one selected from the group of said plurality of stops and one of said outer barriers and one of said plurality of stops, wherein said plurality of channels has a linear profile along said crest, and a spacer for positioning between said handbag holder and a substrate wherein said axis passes generally through said holder, said spacer, and a substrate; wherein said plurality of channels include a main channel and front and rear channels, said main channel being substantially broader than each of said front and rear channels.

4. A system according to claim 3 further comprising a cover wherein said cover comprises a bag having a mouth on one side of said bag, a drawstring around said mouth of said bag, and a pair of handles on generally opposing sides of said mouth of said bag.

5. A system according to claim 3 wherein said spacer creates a distance of about 3 cm between said holder and a substrate.

6. A system according to claim 3 wherein said spacer is integral with said holder.

7. A system according to claim 3 wherein said curved surface has a truncated cylindrical shape and an arc length between about 11 cm and about 20 cm.

8. A system according to claim 3 wherein said crest has a linear profile between said arcuate edges, and wherein each one of said outer barriers is generally perpendicular to said crest.

9. A system comprising:

a handbag holder;

a spacer positioned between said handbag holder and a substrate, wherein a first side of said spacer is configured to removably attach to a substrate and a second side of said spacer is adjacent to said handbag holder; and said handbag holder including a spacer end adjacent to said second side of said spacer, a distal end, a curved surface between said spacer end and said distal end, wherein said curved surface has a truncated cylindrical shape, and wherein said curved surface has a linear profile from said spacer end to said distal end, a plurality of channels disposed on said curved surface and defined between two of a plurality of stops, and said plurality of stops extending radially from and above said curved surface and generally perpendicular to said curved surface; wherein said plurality of channels includes a main channel and front and rear channels, said main channel being substantially broader than each of said front and rear channels.

10. The system according to claim 9 wherein said plurality of stops includes a spacer stop located at said spacer end, a distal stop located at said distal end, and at least one intermediate stop between said spacer stop and said distal stop.

11. The system according to claim 9 wherein said curved surface has one or more holes for passive aeration of a handbag handle.

12. The system according to claim 11 wherein said curved surface has an open end at a truncation of said truncated cylindrical shape.

* * * * *